US009508241B2

(12) United States Patent
DePascale

(10) Patent No.: US 9,508,241 B2
(45) Date of Patent: Nov. 29, 2016

(54) WEARABLE PERSONAL LOCATOR DEVICE WITH REMOVAL INDICATOR

(71) Applicant: Christopher DePascale, Staten Island, NY (US)

(72) Inventor: Christopher DePascale, Staten Island, NY (US)

( * ) Notice: Subject to any disclaimer, the term of this patent is extended or adjusted under 35 U.S.C. 154(b) by 0 days.

(21) Appl. No.: 14/260,788

(22) Filed: Apr. 24, 2014

(65) Prior Publication Data

US 2014/0225730 A1 Aug. 14, 2014

Related U.S. Application Data

(60) Provisional application No. 61/876,484, filed on Sep. 11, 2013.

(51) Int. Cl.
*G08B 1/08* (2006.01)
*G08B 21/02* (2006.01)

(52) U.S. Cl.
CPC ..... *G08B 21/0269* (2013.01); *G08B 21/0288* (2013.01); *G08B 21/0227* (2013.01); *G08B 21/0294* (2013.01)

(58) Field of Classification Search
None
See application file for complete search history.

(56) References Cited

U.S. PATENT DOCUMENTS 6,031,460 A * 2/2000 Banks ..... 340/573.1
7,221,928 B2 * 5/2007 Laird ..... A61B 5/04 340/539.12
7,259,671 B2 * 8/2007 Ganley et al. ..... 340/539.23
7,583,197 B2 * 9/2009 Wesby Van Swaay . H04M 1/05 340/5.61
8,665,085 B2 * 3/2014 Hyatt ..... 340/539.12
2002/0186135 A1 * 12/2002 Wagner ..... 340/573.1
2003/0151506 A1 * 8/2003 Luccetti ..... 340/539.13
2004/0021573 A1 * 2/2004 Hoffman et al. ..... 340/573.1
2005/0253727 A1 * 11/2005 Gonzalez ..... 340/573.4
2006/0232429 A1 * 10/2006 Gonzalez ..... 340/573.1
2008/0001735 A1 * 1/2008 Tran ..... G06F 19/3418 340/539.22
2009/0027193 A1 * 1/2009 Nagy et al. ..... 340/539.13
2010/0238033 A1 * 9/2010 Blumel et al. ..... 340/573.4

* cited by examiner

*Primary Examiner* — Travis Hunnings

(74) *Attorney, Agent, or Firm* — Global Intellectual Property Agency, LLC; Daniel Boudwin

(57) ABSTRACT

Disclosed is a wearable personal locator device that communicates the location of a wearer to an administrator input terminal. The device is a wearable structure comprising either a wristband or adhesive patch, whereby the device registers whether or not the device is actively being worn by the wearer and provides a means to receive alert signals sent from the administrator input terminal. The device includes a processing unit, a power source, an antenna, and a communication means for processing and transmitting location data to the remote input terminal. The device further comprises one of several wearer contact means, including a heat sensor for registering body heat of the wearer, a pressure sensor adapted to be pressed against the wearer, or a frangible circuit that registers when the device is removed from the wearer. The device provides a location monitoring means for children traveling in groups with at least one administrator.

9 Claims, 4 Drawing Sheets

WEARABLE PERSONAL LOCATOR DEVICE WITH REMOVAL INDICATOR

CROSS REFERENCE TO RELATED APPLICATION

This application claims the benefit of U.S. Provisional Application No. 61/876,484 filed on Sep. 11, 2013. The above identified patent application is herein incorporated by reference in its entirety to provide continuity of disclosure.

BACKGROUND OF THE INVENTION

Field of the Invention

The present invention relates to user wearable location devices and GPS systems. More specifically, the present invention relates to a child locator device in which one or more children can be monitored in a given area, wherein a means of determining whether the locator device on the child has been removed is further provided. A reusable embodiment is provided in the form of a wristband, along with a single-use embodiment that contemplates an assembly packaged in an adhesable, disposable structure to be applied to the wearer's skin.

When traveling in groups with children, for instance on a field trip or while on vacation, it can be difficult to keep track of the entire group at all times. Parents, supervisors and teachers must navigate to a desired destination and maintain the trip schedule while remaining in contact with the entire group to prevent any of the children from wandering away or becoming lost. If a child is separated from the group, they can easily become lost or be exposed to strangers, which can be potentially dangerous. For younger children, this is especially true. When younger children are traveling in a group, the group generally stays very close to one another whereby the supervisor or lead parent can maintain visual contact with the children at all times.

However, for older children and young teenagers, many times group trips involve being spread out over a greater area, and the children are not confined to remaining in a singular group under direct supervision from a parent or teacher. This is typical of most middle school or high school trips to museums, for family trips to amusement parks, and similar group trips involving older children. Tracking children of this age who are not necessarily required to stay in a small group is a particular challenge, and of particular concern to the present invention. Without a means to monitor each child's whereabouts, a member of the group can easily become lost or exposed to abduction, whereby the parent or supervisor of the overall group has little control over the situation and is unable to immediately locate each individual of the group when required.

A further concern of the present invention is coordinating group functions while on a trip. Generally for older groups, the parent or teacher will set a schedule in which the group must reconvene and meet at a given time and place. The group can spread out over the area, but must return to a common meeting ground at a specified time. It is not unusual for some group members to become unaccounted for or be late to such coordinated meeting times. Therefore, a means of not only locating a child, but also sending alerts or return signals to the group members is desired. The present invention addresses both of these functions with a wearable locator device with a location means therein, and a means to send a signal from the group coordinator to each wearable locator device to reconvene.

A final concern of the present invention relates to worst case scenarios for those in group trips—abduction or becoming inadvertently lost. The present invention contemplates a means of monitoring the wearable locator device itself with a means of identifying when the monitoring device has been removed from the wearer's body. Embodiments of this include a body temperature sensor and a frangible circuit that is broken when removed from the wearer's skin. Overall, the goal is to alert a supervisor or parent when the wearable locator device has been tampered with or completely removed, whereby a signal is generated when the child locator device is no longer transponding a signal or when the system detects the device is no longer being worn by the wearer.

The present invention contemplates two primary embodiments that are capable of tracking the location of a wearer and sending a signal to an administrator. These include a reusable wristband embodiment that houses the necessary circuit and location transponder means therein, as well as a single-use, adhesable embodiment worn directly on the skin of a wearer. The latter embodiment contemplates an adhesable bandage type structure with the necessary circuit and location transponder means therein. Both embodiments register whether the device is being physically worn while deployed, and is adapted to recognize or be recognized by an administrator when removal from the wearer is registered. The overall goal is to prevent children on group trips from becoming lost or abducted, wherein the supervisor for the group has an immediate means of locating each member of the group. Further provided is a means for the system to broadcast a signal to each wearable device, whereby the signal corresponds with a notice to reconvene at a predetermined location.

Description of the Prior Art

Devices have been disclosed in the prior art that relate to GPS devices and locators. These include devices that have been patented and published in patent application publications, and generally relate to wearable locator devices that fail to recognize when the device is actually being worn by the wearer, and those that disclose structures diverging in characteristics from the present invention. The following is a list of devices deemed most relevant to the present disclosure, which are herein described for the purposes of highlighting and differentiating the unique aspects of the present invention, and further highlighting the drawbacks existing in the prior art.

One such device of the prior art is U.S. Pat. No. 7,564,405 to Durst, which discloses an object locator system to obtain the location of an individual or animal wearing a locator device, wherein a two-way paging system and GPS system are utilized. The system is contemplated for lost pets and the like, wherein the system ideally activates when the animal or wearer strays from a given area to conserve battery power. The system utilizes a mobile communications unit to send location data from the device to a base station for interpretation by a human user. The Durst device, while providing a wearable positioning system, fails to contemplate the means in which the present invention is deployed and a means to detect when the wearable locator is removed from the wearer. The present invention contemplates two wearable embodiments, along with a wearer contact means to determine if the device has been removed from the wearer.

Another device is U.S. Patent Publication No. 2012/0182145 to Jameson, disclosing an animal tracking system that locates an animal and then tracks its location for a user to visualize and to determine where the animal is currently traveling. The system comprises a first GPS device on the animal, which transmits data to a second device. The second device can determine the orientation of the first device relative to the first, and further includes a display unit to display a graphical representation indicating the location and direction of the first device relative to the second. The Jameson device is contemplated for tracking pets and animals; however it fails to notify the user when the device worn by the animal is removed from the animal. Moreover, the Jameson device fails to contemplate the use or specific structure deployed in the child locator system of the present invention.

U.S. Patent Publication No. 2009/0289785 to Leonard discloses a tracking system for individuals, pets, or possessions that includes a GPS transmitter that is adhesively joined to the wearer or possession. The transmitter is capable of transmitting a tracking signal to a GPS receiver that can track the location of the transmitter and display its position on a map display. The transmitter is adapted to be attached to the body surface of the item or person being tracked. An activation button on the patch allows a user to activate the transmitter in the event of an emergency. The Leonard system provides for a similar structure as that of the present invention, wherein a temporary or single-use patch is provided. However, Leonard provides no means of determining if the patch has been removed from the wearer or tampered with. The present invention utilizes a wearer contact means that continually registers the user or ceases operation upon being tampered with. Embodiments include a pressure sensor, a temperature sensor, and a frangible adhesive that registers when the device is removed from the wearer.

Finally, U.S. Patent Publication No. 2007/0069891 to Wallace discloses a receiver unit and a child locator system that utilizes a transmitter to activate an audible signal on the receiver such that a parent or guardian can locate the child when in audible range. The receiver includes a microcontroller, a receiver antenna, a power source, and a transformer unit. The system comprises a transmitter that allows a parent to send a signal to actuate a receiver unit, whereby the receiver unit provides an alarm in response to the transmission of the signal from the transmitter on the child. The Wallace system, while useful for locating children, provides an audible location means rather than a location tracking means that can be used beyond audible range. The present invention contemplates a device that utilizes ground based GPS and a means of tracking the exact location across greater distances, along with unique structure suitable for executing the system, supported by the wearer and capable of recognizing when the device is removed or tampered.

It is submitted the present invention provides a locator system and specific device that diverges in elements from the prior art, and consequently it is an existing need in the art for child locator devices that allow an administrator to track a plurality of children across wide areas using a common terminal and wearable locator devices that register the device is being actively worn. In this regard the instant invention substantially fulfills these needs.

SUMMARY OF THE INVENTION

In view of the foregoing disadvantages inherent in the known types of wearable locator devices now present in the prior art, the present invention provides a new device that can be deployed on field trips and group trips in which several children or teenagers can be tracked over a distance by an administrator. The present invention provides a level of comfort for parents and allows the administrator to monitor the location of the wearable devices, determine that they are indeed being worn, and finally directly communicate therewith to regroup.

It is therefore an object of the present invention to provide a new and improved wearable locator device that has all of the advantages of the prior art and none of the disadvantages.

It is another object of the present invention to provide a wearable locator device that includes a GPS tracking unit, an alert means, and a wearer contact means to facilitate wearer location, group communication, and wearer compliance, respectively.

Another object of the present invention is to provide a wearable locator device that includes a GPS tracking unit that processes and transmits its location via a network to a remote server, which in turn is readable by an administrator input terminal.

Yet another object of the present invention is to provide a wearable locator device that includes a reusable wristband structure supporting the electronic elements of the device in a housing thereon, wherein the device further includes a wearer contact means thereon and a speaker for projecting an audible alert.

Another object of the present invention is to provide a wearable locator device that is disposed within a single-use adhesive patch, wherein the patch is adhesable directly to the skin or clothing of a wearer and includes the elements of the reusable wristband therein.

Another object of the present invention is to provide a wearable locator device that provides a wearer heat sensor, pressure sensor, or a frangible circuit to determine whether the wearer is wearing the locator device of the present invention.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
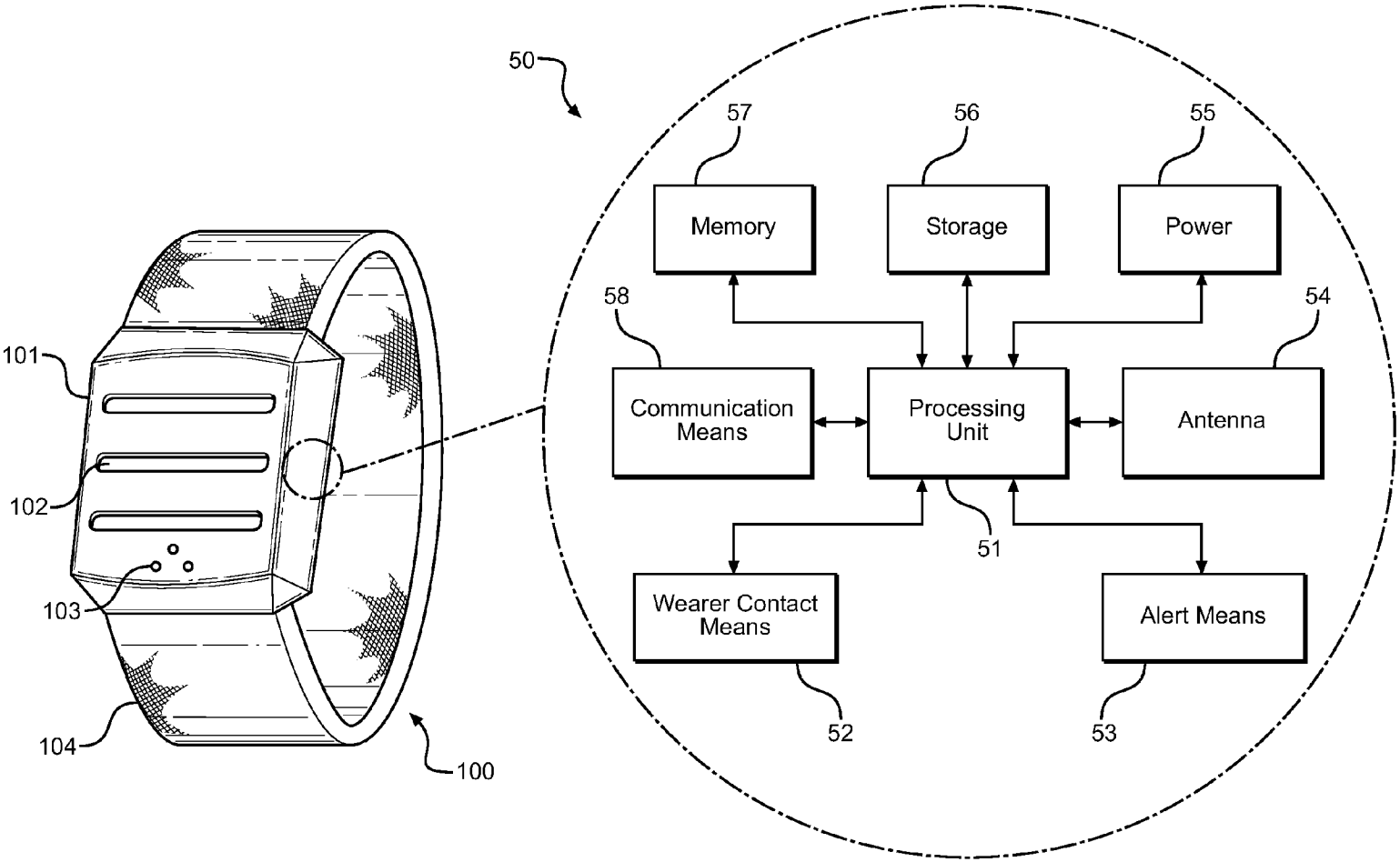
FIG. 1 shows the wristband embodiment of the present invention and the system elements of the locator device.

Reference is made herein to the attached drawings. Like reference numerals are used throughout the drawings to depict like or similar elements of the wearable locator device of the present invention. For the purposes of presenting a brief and clear description of the present invention, the preferred embodiment will be discussed as used for maintaining contact with and tracking one or more children in a group while traveling, wherein the children each wear a locator device that can be monitored by an administrator. The figures are intended for representative purposes only and should not be considered to be limiting in any respect.

Referring now to FIG. 1, there is shown a view of the wristband embodiment 100 of the wearable locator device of the present invention, along with the components therein that facilitate location determination and communication with an administrator. The wristband embodiment 100 comprises a band 104 adapted to be worn on the arm or leg of a wearer, and includes a housing 101 that supports the electrical components 50 therein. The wristband 100 may take on different designs, shapes, and materials, falling within the scope of providing a readily deployable and relatively inexpensive band with electronic features therein. Along the exterior of the housing 101 is a speaker 103 and/or a visual alert means 102 such as a light source or similar display.

Within the housing, each wristband includes a processing unit 51 that is a microprocessor or computer processing unit (CPU), which controls the operation of the device and coordinates between the various inputs and outputs of the thereof. The device further includes computational storage 56 and memory 57, a power source 55, and means for communicating and determining the physical location of the band. The latter comprises a communication means 58 that interprets GPS data and determines the location of the device while the device is operational. An antenna 54 is provided for communicating the location from the device to an administrator, wherein a signal is sent over a network to a server, which in turn can be accessed by an administrator input terminal (e.g. a smartphone or equivalent) while traveling.

The communication means 58 comprises a GPS tracking unit that preferably uses a cellular signal to triangulate the location of the wearable device, and thus the location of the wearer in real-time. The GPS tracking unit preferably comprises a GPRS module or equivalent that operates over a GSM network, wherein location data is transmitted via the antenna 54 over the cellular network to a server at regular intervals. The administrator, which is likely a teacher or parent, can log on to their input terminal and retrieve the data in real-time, thereby displaying the location of the wearer on the terminal.

Along with tracking the location of the device, the present invention further contemplates a means to determine if the device is still actively being worn by the wearer, and therefore acknowledge that the wearer is actively being tracked and the location signal of the wearer is valid. This prevents users from removing their bands without administrator knowledge, and also prevents tampering by third parties trying to remove the tracking device without authorization.

Figure 2:
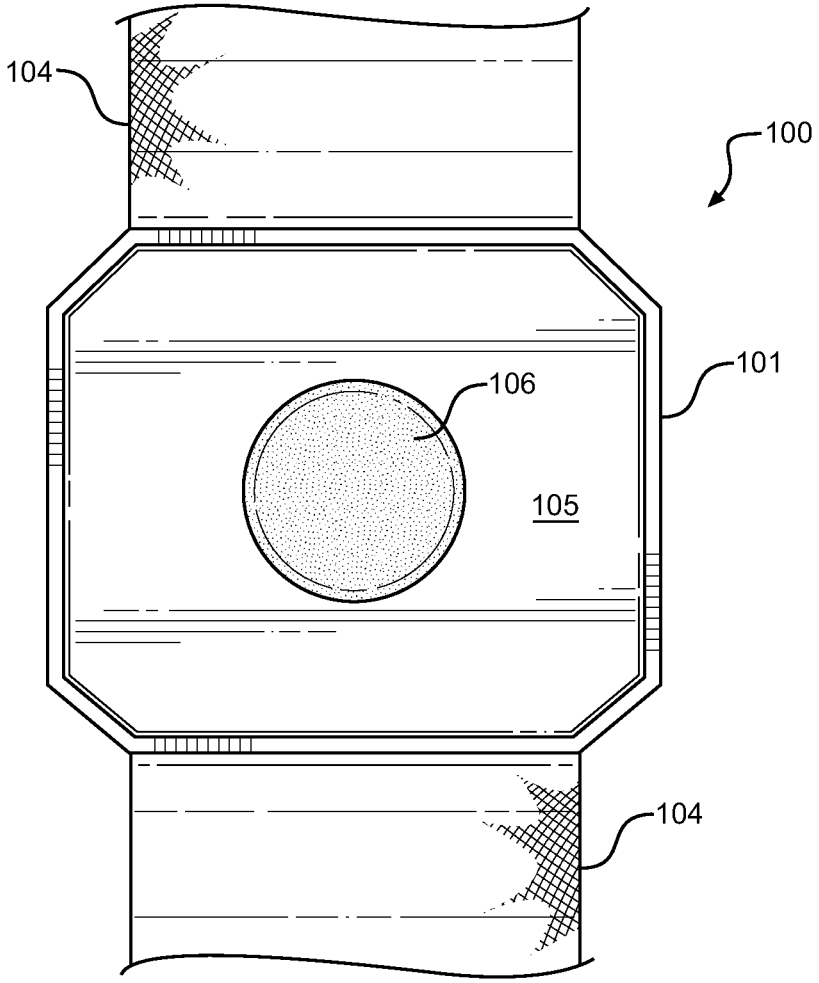
FIG. 2 shows the underside of the wristband embodiment of the present invention, wherein the underside wearer contact means may be disposed.

Two embodiments of wearer contact means 52 are contemplated in the wristband embodiment 100 of the present invention, both of which are shown in FIG. 2. The wearer contact means 52 comprises either a heat sensor or a pressure sensor disposed along the underside surface 105 of the housing 101, whereby the strap or band 104 of the wristband is adapted to securely abut the underside surface 105 to the wearer's skin. A sensor contact area 106 is provided along the underside surface 105, whereby heat or contact pressure is monitored. If the wristband 100 is removed from the wearer's wrist or ankle, the sensor will register a change in state. For a heat sensor, the wearer's body temperature will no longer be measured and the sensor will register a cooler environment, thereby triggering an alert to the administrator. Similarly, the pressure sensor registers when the pressure thereagainst is out of limits with what is expected or established upon being donned, thereby triggering the same alert to the administrator.

The wearer contact means 52 is meant as a failsafe, whereby the administrator is alerted when the band is no longer being worn by the child, and the signal therefrom is marked on the input terminal for the administrator to travel to that location to investigate. This provides a means for a parent or teacher to realize if a child has been interfered with by a third party, or if the wearer is not complying and is not actively wearing the device. A signal is sent upon a change in state of the contact means 52, triggering a signal on the administrator input terminal.

Along with contact monitoring and position tracking, the present invention also provides a direct means of communication between the administrator and the wearable devices. It is contemplated that an alert means 53 in the form of an audible alert or visual alert is provided on each wristband. A broadcast signal sent over a network can trigger the alert, whereby the wearer is given notice that he or she must reconvene to a predetermined location. The alert means is a simple mechanism to allow an administrator to broadcast a common signal to all wearers that an event has occurred, and to reconvene to a location determined prior to the trip. Examples of this include a return home signal for children playing outside, a signal that everyone must assemble at a given meeting place, or similar situations in which each wearer knows to end the current activity and join the group at the pre-designated assembly location. The signal is preferably broadcast over the cellular network, which in turn is registered by the antenna 54, translated by the processing unit 51 and/or communication means, and thereafter used to trigger the alert means 53 (audile or visual alert via the speaker 103 or visual alert means 102, respectively).

Figure 3:
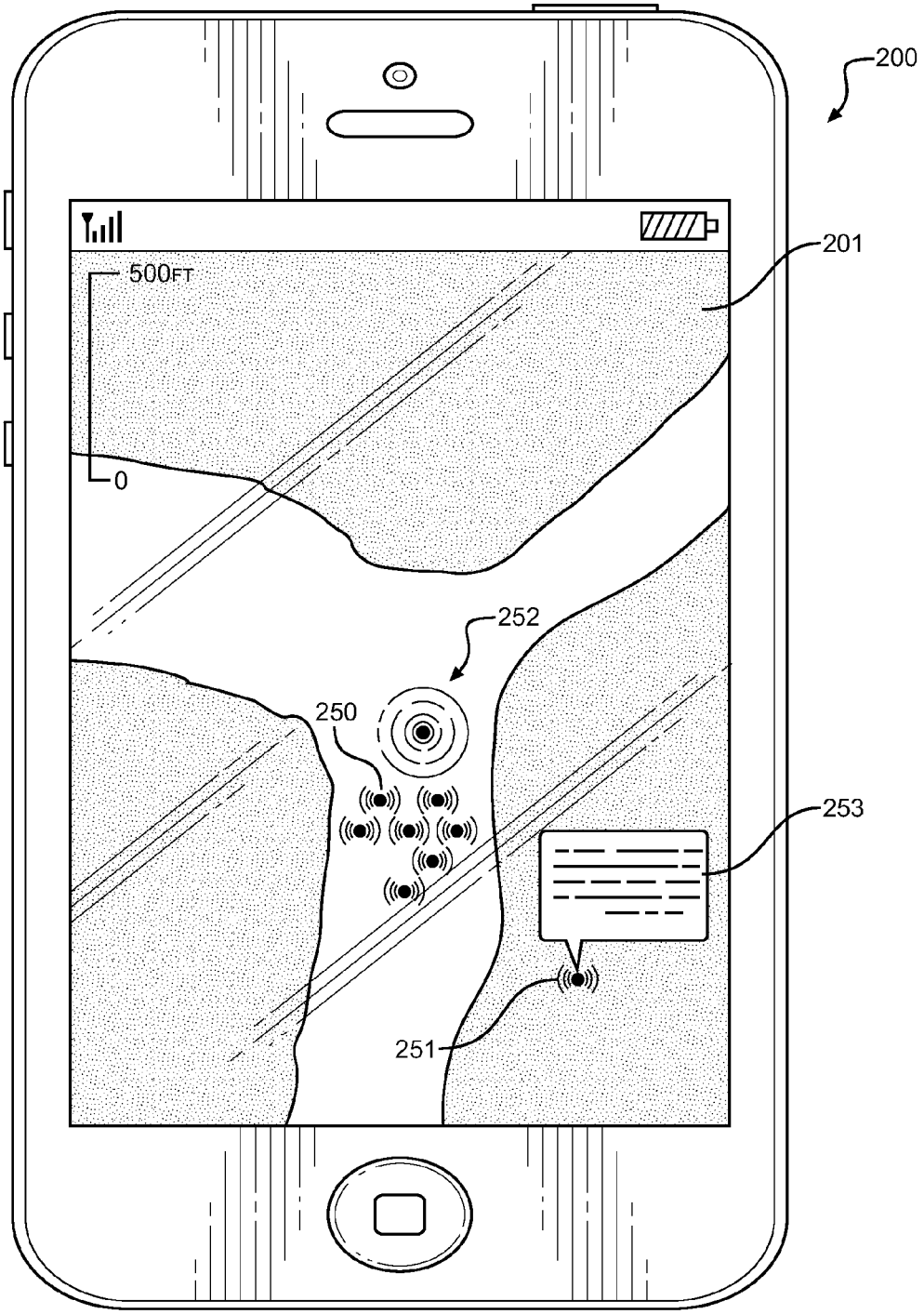
FIG. 3 shows a view of the administrator input terminal used to visualize the location of the deployed locator devices and for communicating therewith.

Referring now to FIG. 3, there is shown a view of the input terminal 20 of the present invention, which the means in which an administrator monitors the location of the wearable locator devices of the present invention. An interface layer is provided on the input terminal 20, which allows the user to log on using a registered log-in, whereafter the wearable locator devices are registered to the specific user. This allows the one user to track specific devices, and only those devices that are registered with his or her account. The input terminal is preferably a smartphone device, and the application layer is an application that communicates with a remote server. The remote server verifies the credentials of the user and receives the location data from the individual tracking devices, whereby the remote server preferably acts as the go-between.

Once the application layer is launched and the user's credentials are verified, the user can track those wearable locator devices that have been registered to the user's account. The display 201 of the input terminal provides an overhead map, showing the location of the input terminal itself 252 and the plurality of locator devices 250 being actively tracked. Each of the locator devices continually updates the remote server of its location, whereby the location is then transmitted to the input terminal and displayed for the user/administrator.

The input terminal 200 allows the administrator to visually monitor the location of the group by individual wearer. If a wearer strays from the group, the administrator can query the specific wearer 251 and determine who the individual wearer 251 is from the identification of the locator device being worn. Each of the locator devices is individually logged and has a unique identifier, wherein data 253 from each can be interrogated via the application layer to determine the identity of the wearer. The application layer allows the administrator to log each wearer and mark the specific locator that corresponds to the wearer, which is thereafter stored on the remote server for subsequent retrieval. The application layer also allows the administrator to broadcast the alert signal when desired, either to reconvene the group in the event of an emergency or at a specified time.

Figure 4:
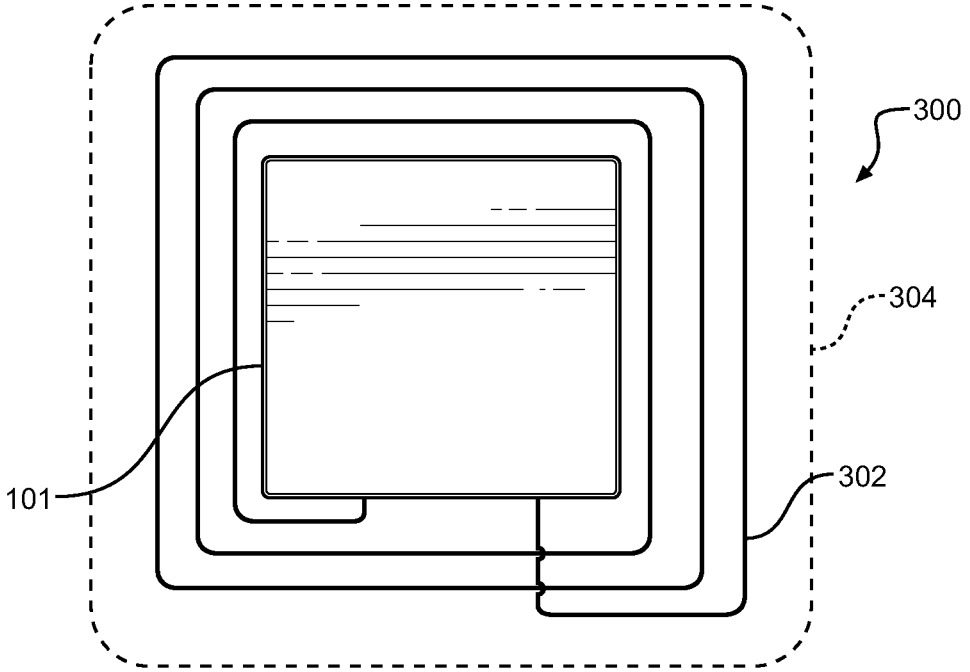
FIG. 4 shows a view of the adhesable patch embodiment of the present invention.
Figure 5:
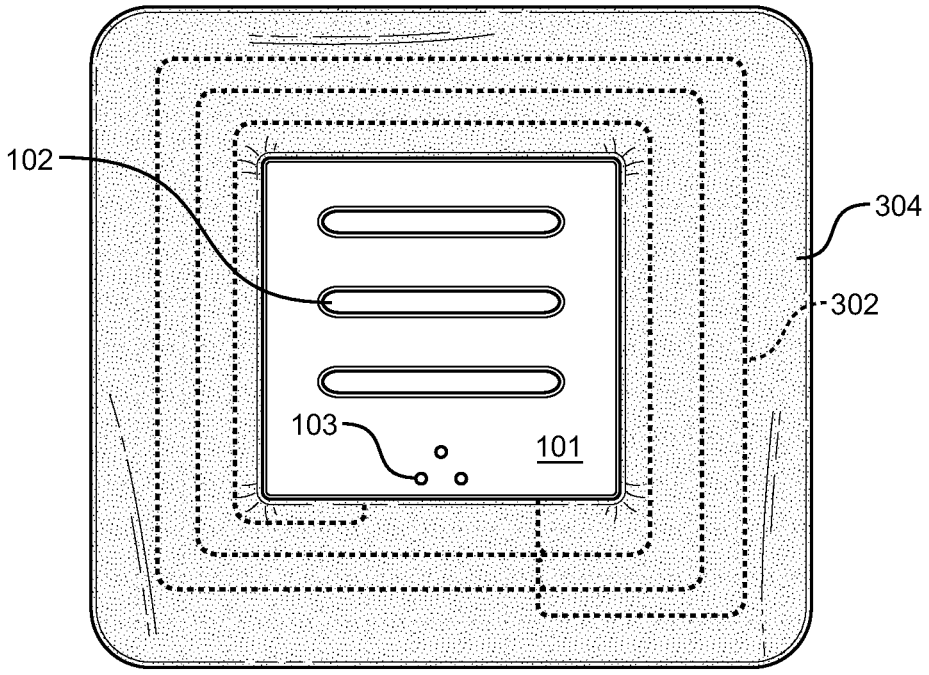
FIG. 5 shows another view of the adhesable patch embodiment of the present invention.

Referring now to FIGS. 4 and 5, there is shown the second embodiment of the wearable locator device of the present invention. The second embodiment comprises an adhesive patch 300 that includes a centrally located and enclosed pouch that supports the same or substantially the same housing 101 of the wristband embodiment. This embodiment contemplates an adhesive patch in the same manner as a skin bandage, wherein the outer periphery comprises an adhesive layer 304 and a housing 101 is disposed within the interior of the adhesive layer 304. This embodiment is suitable for adhering a locator device to a younger child, wherein the adhesive patch is used a single time and is discarded, while the housing 101 may be disposable or may be removable from the central pouch to be placed in a replacement pouch when redeployed. This embodiment does not rely on a wristband, but adheres directly to the skin or clothing of a wearer. The pouch itself is preferably a waterproof structure that supports the housing 101 therein, whereby a child in rain or at a waterpark will not cause damage to the electronics elements therein.

The electronic components of the housing of the adhesive patch 300 embodiment remain unchanged from the wristband embodiment, however an alternate wearer contact means is contemplated. Along with either a heat sensor or a pressure sensor, this embodiment further contemplates a frangible circuit 302 disposed within the adhesive layer 304. The frangible circuit 302 is a circuit with an elongated wire or electrical connection that is adapted to shear apart or sever when the adhesive layer is pried or otherwise removed from the original wearer. This structure is common in garment sensors, wherein the circuit maintains electrical connectivity and a breach of the connection between the adhesive layer 304 and the wearer causes the electrical connection to sever or short. This discontinuity is registered by the processing means and triggers an alert in the same manner as the heat sensor or pressure sensor. Along with the wearer contact means, the housing 101 may further comprise a speaker 103 and/or visual alert means 102 for which the wearer to be given a signal from the administrator.

Overall, the present invention provides an inexpensive and readily deployable device and method that operates within a wireless system to track the location of several users within a group, and allow the leader or administrator of the group to track each group member's location. The device is well suited for group field trips, for tracking a singular child playing outdoors, and for other events in which the location of one or more individuals is desired and where tampering with the device is not tolerated. The device ensures the wearer maintains compliance with regard to wearing the device, and the administrator is alerted when the user is no longer being registered in connection with the locator device. Finally, the device provides a means to send an alert signal to the wearer or wearers, wherein a predetermined action is designated such that the wearer recognizes the signal and takes appropriate action.

The system of the present invention utilized by the disclosed method comprises a wireless network, preferably a cellular network, wherein the GPRS module in the locator device can receive location data and transmit the same using a GSM or equivalent cellular network. The data is processed by a remote server in communication with the network, which in turn communicates to the administrator via an input terminal. The input terminal includes a wireless antenna, wherein a cellular and/or WiFi network is used to access the remote server and retrieve data therefrom. The data is communicated to through an application layer executed on the input terminal, wherein the user can interrogate the application layer to visualize each of the wearers and to signal alerts thereto.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wearable article comprising:

a band;

a wearer sensor disposed on an undersurface of the band, the wearer sensor configured to detect whether the wearable article is worn by a user;

the wearer sensor comprising:

a frangible circuit;

an adhesive layer configured to contact the user when the wearable article is worn;

wherein the frangible circuit is configured to sever when the adhesive layer is removed from the user;

a GPS receiver configured to detect a location of the wearable article;

a processor;

a transceiver;

the transceiver configured to transmit a warning signal to a terminal when the wearer sensor detects that the wearable article has ceased to be worn by the user;

the transceiver configured to receive an alert signal from the terminal, wherein the wearable article is configured to generate an alert when the alert signal is received;

the transceiver configured to transmit the location to the terminal.

2. The wearable article of claim 1, the wearer sensor comprising a pressure sensor.

3. The wearable article of claim 1, the wearer sensor comprising a heat sensor.

4. The wearable article of claim 1, the wearer sensor comprising a visual alert.

5. The wearable article of claim 1, the wearer sensor comprising a pressure sensor.

6. A locator and alert system comprising:

a terminal comprising a display, the terminal connectable to one or more wearable articles;

each of the one or more wearable articles comprising:

a band;

a wearer sensor disposed on an undersurface of the band, the wearer sensor configured to detect whether the wearable article is worn by a user;

the wearer sensor comprising:

a frangible circuit;

an adhesive layer configured to contact the user when the wearable article is worn;

wherein the frangible circuit is configured to sever when the adhesive layer is removed from the user;

a GPS receiver configured to detect a location of the wearable article;

a processor;

a transceiver;

the transceiver configured to transmit a warning signal to a terminal when the wearer sensor detects that the wearable article has ceased to be worn by the user;

the terminal configured to generate a warning alert when the terminal receives the warning signal;

the terminal configured to receive the location from each of the one or more wearable articles and visualize the location from each of the one or more wearable articles on the display;

the terminal configured to transmit an alert signal to the one or more wearable articles, the alert signal configured to generate an alert on the one or more wearable articles when the alert signal is received thereby.

7. The locator and alert system of claim 6, the terminal configured to receive a unique identifier associated with each of the one or more wearable articles for visualization on the display.

8. A wearable article comprising:

a wearer sensor disposed on an undersurface of the wearable article, the wearer sensor configured to detect whether the wearable article is worn by a user;

the wearer sensor comprising:

a frangible circuit;

an adhesive layer configured to contact the user when the wearable article is worn;

wherein the frangible circuit is configured to sever when the adhesive layer is removed from the user;

a GPS receiver configured to detect a location of the wearable article;

a processor;

a transceiver;

the transceiver configured to transmit a warning signal to a terminal when the wearer sensor detects that the wearable article has ceased to be worn by the user;

the transceiver configured to receive an alert signal from the terminal, wherein the wearable article is configured to generate an alert when the alert signal is received;

the transceiver configured to transmit the location to the terminal.

9. The wearable article of claim 8, wherein the wearable article is a patch.

* * * * *